US005450955A

United States Patent [19]

Olson

[11] Patent Number: 5,450,955

[45] Date of Patent: Sep. 19, 1995

[54] THROAT STRUCTURE FOR GOLF BAG

[76] Inventor: Rolf T. Olson, P.O. Box 3405, Salem, Oreg. 97302

[21] Appl. No.: 164,282

[22] Filed: Dec. 7, 1993

Related U.S. Application Data

[60] Division of Ser. No. 804,616, Dec. 2, 1991, abandoned, which is a continuation-in-part of Ser. No. 625,757, Dec. 11, 1990, abandoned.

[51] Int. Cl.[6] ..... A63B 55/00

[52] U.S. Cl. ..... 206/315.6; 206/315.3; 206/315.7

[58] Field of Search ..... 206/315.2, 315.3, 315.6, 206/315.7, 315.8, 315.5; 248/96, 156; D3/320

[56] References Cited

U.S. PATENT DOCUMENTS

| | | | |
|---|---|---|---|
| D. 316,779 | 5/1991 | Henderson et al. | D3/37 |
| 1,444,357 | 2/1923 | Pierce | 206/315.7 |
| 1,452,084 | 4/1923 | Luckett | 206/315.7 |
| 1,596,231 | 8/1926 | Bennett | 206/315.7 X |
| 1,606,504 | 11/1926 | Burky | 248/96 |
| 1,612,741 | 12/1926 | Newman-Butler | 206/315.6 X |
| 1,715,668 | 6/1929 | Mooney | 248/96 |
| 1,739,702 | 12/1929 | Wing | 248/96 |
| 1,811,246 | 6/1931 | Boden et al. | 248/96 |
| 1,904,731 | 4/1933 | Harris | 206/315.7 |
| 4,071,062 | 1/1978 | Ianetta | 206/315.7 |
| 4,596,328 | 6/1986 | Solheim | 206/315.6 |
| 4,600,100 | 7/1986 | Solheim | 206/315.6 |
| 4,667,820 | 5/1987 | Solheim | 206/315.6 |
| 4,685,561 | 8/1987 | Reimers | 206/315.6 |
| 4,796,752 | 1/1989 | Reimers | 206/315.6 X |
| 4,834,235 | 5/1989 | Solheim et al. | 206/315.8 X |
| 4,844,253 | 7/1989 | Reimers | 206/315.6 |
| 4,942,962 | 7/1990 | Jordon | 206/315.7 |

FOREIGN PATENT DOCUMENTS

| | | | |
|---|---|---|---|
| 201454 | 8/1923 | United Kingdom | 206/315.7 |

*Primary Examiner*—Bryon P. Gehman
*Attorney, Agent, or Firm*—Charles N. Hilke

[57] ABSTRACT

This invention provides a golf bag with an integral bottom section that will stabilize the golf bag in a free standing upright position. The bottom section implements three downward protruding feet arranged triangularly. The foot extending from each vertex is located at a distance beyond the circumference of the golf club container. The tripod positioned feet carry the weight of the golf bag. With downward pressure applied the feet may be used to penetrate the grassy surfaces of a golf course thereby aligning the golf bag vertically. The second and fourth embodiments of this invention give the user the option of extending the feet laterally to give further stability. A triangular shaped throat structure is provided with cross members forming four openings at the top of the golf bag. Finally, an additional handle is provided at a point at or above the throat structure of the golf bag and adjacent to and beyond the circumference of the throat structure.

3 Claims, 9 Drawing Sheets

THROAT STRUCTURE FOR GOLF BAG

This is a divisional of application Ser. No. 07/804,616 filed on Dec. 2, 1991, now abandoned, which is a continuation-in-part of application Ser. No. 07/625,757 also now abandoned.

SUMMARY OF INVENTION

The objective of this invention is to provide a golf bag with a bottom section that will stabilize the golf bag in a free standing vertical and upright position.

This upright position of stability is achieved by implementing the following design features:

A. The use of three feet arranged triangularly protruding downward to the ground from the bottom section of the golf bag, and B. The use of three feet designed to either rest on the top of the grassy surface of the golf terrain or with downward pressure applied to one or more of the feet to penetrate the grassy, uneven surfaces of golf courses, thereby causing alignment of the bag vertically and further said penetration causing the golf bag to be secured to the surface of the ground, and C. The use of three feet positioned at corners of a triangular shape which are located outside the circumference of the container above carrying the golf clubs, thereby keeping the weight of the upright clubs within the triangular shape created by the position of the feet below, and D. The use of tripod positioned feet, the prongs of which rest on or in the ground and bear the entire weight of the golf bag and contents; and as an option, E. In the second and fourth embodiments of this invention the use of three feet positioned as referenced above in paragraphs A, B, C, and D which can be extended laterally to increase the length of each side of the triangle, thereby further increasing stability of the golf bag in a upright position as the slope of golfing terrain may increase.

The objective of this invention is to provide a new handle for the common golf bag that will assist the golfer or caddie in moving the golf bag that will assist the golfer or caddie in moving the golf bag from one location or position to another.

Generally, golf bag handling devices now consist of a flexible shoulder sling, a semi-rigid handle located between the two fasteners of the shoulder sling and occasionally a semi-rigid strap located near the closed end of the bag.

A special need for the new handle of this invention exists when the golfer or caddie is moving the golf bag from a shoulder carrying position to rest the bag on the ground in a vertical position. Presently, no handle exists on golf bags at or above the throat structure of the golf bag and adjacent to and beyond the circumference of the throat structure of the bag. At that specific location the person carrying the golf bag needs a grasp for the hand opposite the shoulder which carries the bag as the golf bag is being removed from the shoulder and rested vertically on the ground.

The handle of this invention is constructed as an integral part of the throat structure of the bag through the well known plastic injection molding process. However, the handle can also be formed independently with a weight bearing material then fastened securely to the throat with rivets or other fasteners.

This invention provides the golfing public with an innovative golf bag throat structure design. The shape of the throat is triangular and is divided into four openings. Each vertex of the triangle is bounded by a cross member thereby forming one opening for each of the three triangular corners. The fourth opening is in the middle of the triangle, spanning two sides. The two cross members spanning the triangle from one side to the other form a chevron shape.

The above-described design enhances the common throat structure divider in the following manner:

First, by segregating three groups of golf clubs in each of the corners of the triangle the golf bag is balanced, thereby giving more stability to the bag when maneuvered into a vertical resting position. With each of these three groups of golf clubs confined to a vertex they cannot slide from side to side and imbalance is consequently prevented.

Secondly, the chevron shaped cross members cause the golf clubs to gather in the center of the throat structure when the golf bag is carried by the shoulder sling thereby promoting greater stability when the bag is in a horizontal position and also when the golf bag is rested vertically on the ground.

PRIOR ART

Devices designed in previous times to vertically support a golf bag are numerous and vary in specific features.

To categorize, it can be said that some of these devices are solely attachments to the bottom of an existing golf bag such as in Luckett, U.S. Pat. No. 1,452,084 and in Bryton, U.S. Pat. No. 3,532,313 and in Ianetta, U.S. Pat. No. 4,071,062.

Other devices attach to the side of an existing golf bag such as in Parduhn, U.S. Pat No. 4,691,884 and in Schiltz, U.S. Pat No. 3,666,221 and in Leis, U.S. Pat No. 3,747,313 and as in Rombach, U.S. Pat No. 4,108,409.

Still other devices are designed as an integral part of the golf bag such as in the following U.S. patents:

1) Kim, U.S. Pat. No. 4,635,793 (Full length center rod with four feet); 2) Weise, U.S. Pat. No. 4,782,948 (Bottom section with four feet); 3) Reimers, U.S. Pat. No. 4,778,136 (Side mounting of two legs); 4) Williams, U.S. Pat. No. 4,865,192 (Full length center rod with single spike).

None of the prior art however has the same design features as the present device. This invention meets the objective of stabilizing the golf bag in a free upright position with simplicity, reliability, minimal weight and minimal cost by incorporating into the bottom section of the golf bag three feet triangularly positioned outside the circumference of the golf club carrier above.

In the second and fourth embodiments of this invention the user may extend the feet laterally as the slope of the golfing terrain requires adjustment for greater stability.

More specifically, the present device distinguishes itself from prior art in that:

1) The device is not an attachment, rather the invention is an integral part of the bottom section of the golf bag.

2) The device is not integrated to or attached to the side or through the center of the golf club container, rather the invention is integrated only into the bottom section of the golf bag.

3) The device is not dependent on a single spike or two legs or four prongs as in prior art, but rather stability of this invention is achieved with a three foot triangular-tripod design.

4) Unlike prior art this device does not require the movement of any parts of the golf bag stand as the user moves the bag from the carrying position to the free standing upright position, rather the stand is in or is set in a fixed position and that position is maintained whether the bag is being carried or standing vertically on the ground.

5) Lastly, unlike prior inventions of golf bag stands the supporting feet suspend the bottom section of the club container off the ground by use of downward protruding feet positioned triangularly outside the circumference of the container above.

Golf club bags commonly contained a golf club divider section in the throat structure of the golf bag. This divider serves the general purpose of organizing the golf clubs and providing for ease of movement of clubs in and out of the bag.

Prior inventions have provided dividers that separate each golf club from one another such as Leitzel U.S. Pat. No. 4,136,724, Clark, et al U.S. Pat. No. 4,522,299, and Stamp U.S. Pat. No. 2,752,973; and more general area dividers such as a Solheim U.S. Pat. Nos. 4,600,100, 4,667,820 and 4,596,328.

However, none of the prior art directs design attention to stability of the golf bag in both a vertical and horizontal position by using dividers that organize golf clubs in strategically located groups.

The present invention enhances position stability of the golf bag by combing the use of:

(1) A triangular shaped throat;

(2) Separating open areas located in each of the vertices of the throat, and;

(3) Chevron shaped boundary cross members for dividing the throat structure.

None of these features are found in prior art relating to golf bag dividers.

Handling devices for golf bags have evolved over the years into three main types:

1) The shoulder sling fastened to the bag at the throat structure and the opposite end of the shoulder sling fastened down and away from the throat approximately two-thirds of the length of the bag;

2) The hand grasp semi-rigid handle located between the two shoulder sling fasteners;

3) Occasionally the hand grasp semi-rigid handle located near the closed end of the bag.

Prior recorded art for golf bag handling devices includes Renshaw U.S. Pat. No. 3,548,905 (relating to types of handles one and two cited above); Kish, Jr. U.S. Pat. No. 2,861,614 (relating to an adjustable shoulder sling); Strutz U.S. Pat. No. 3,882,914 (relating to specific strap construction).

None of the prior art features a handling device such as invented here which locates a hand grasp at a point at or above the throat structure of the golf bag and adjacent to and beyond the circumference of the throat structure of the golf bag.

DETAILED DESCRIPTION OF PREFERRED EMBODIMENTS

Figure 1:
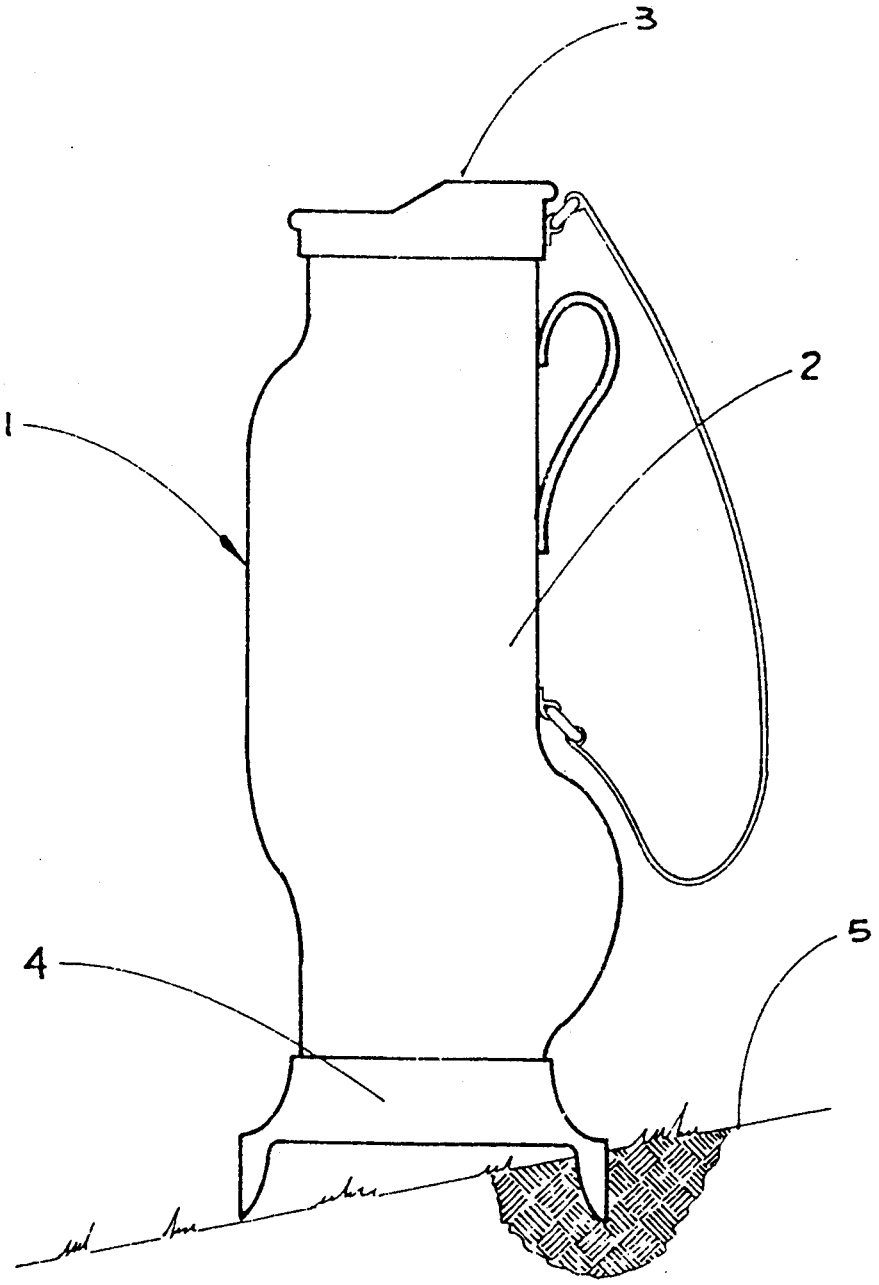
FIG. 1 shows a side view of a standard golf bag with the invention.
Figure 2:
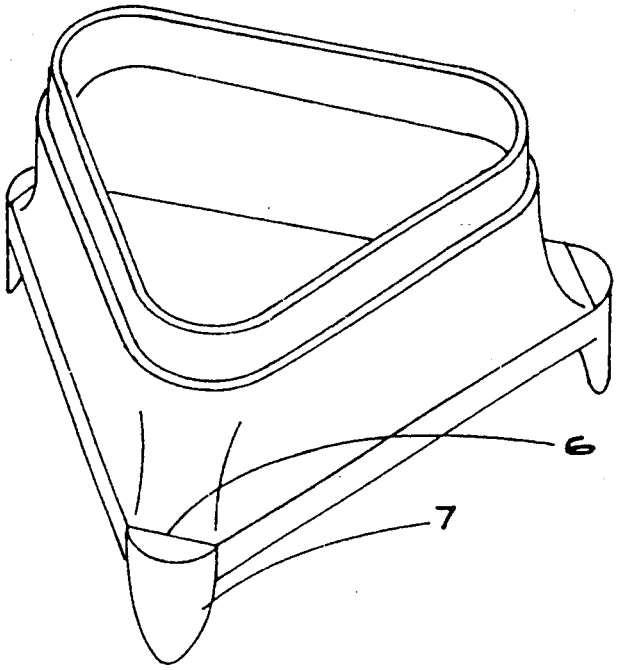
FIG. 2 shows the first embodiment of the closed bottom section of the golf bag.
Figure 3:
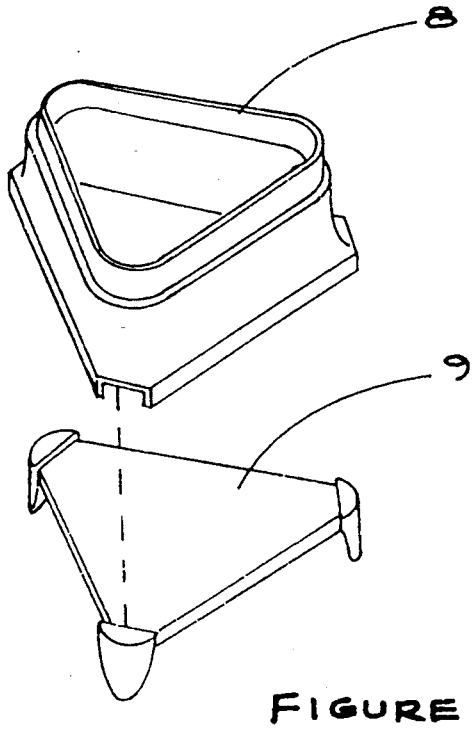
FIG. 3 shows the two separate parts of the first embodiment of the closed bottom section of the golf bag.
Figure 4:
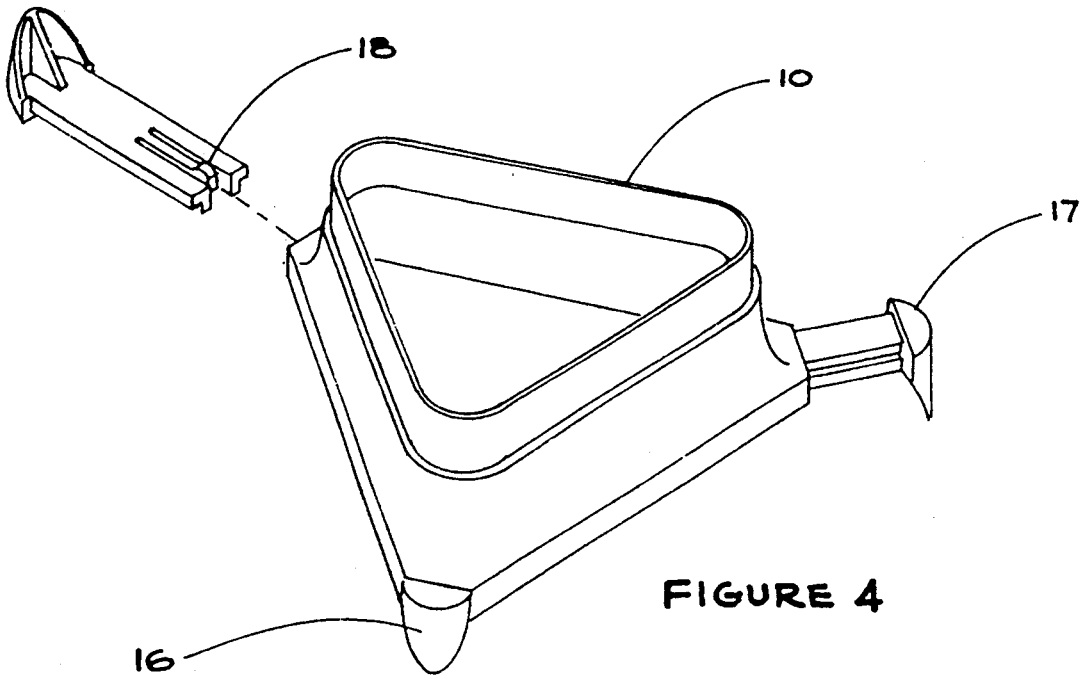
FIG. 4 shows the second embodiment of the closed bottom section of the golf bag with one foot removed and rotated 180 degrees showing the underside design of said foot.
Figure 5:
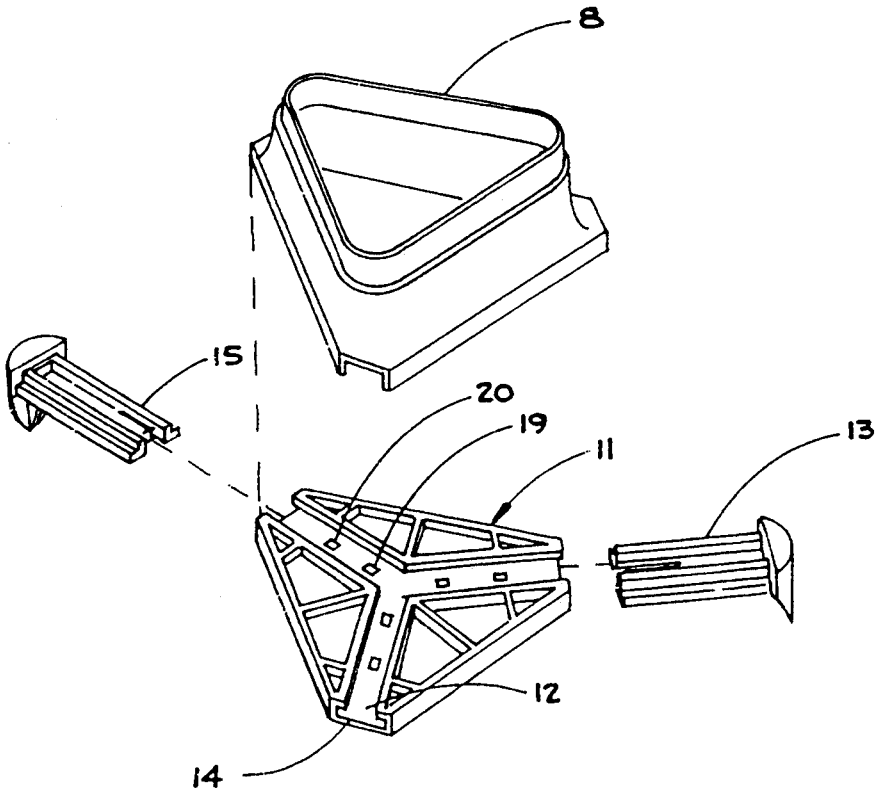
FIG. 5 shows the separate parts of the second embodiment of the closed bottom section of the golf bag.

Referring to FIGS. 1 through 10 a conventional golf bag 1 is illustrated comprising a golf club container 2 formed by use of plastic sheeting and surrounded by fabric designed with various pockets, an open upper divider 3, and a closed bottom 4 section. These parts are secured together in any manner, but normally by sewing or with rivets.

The closed bottom 4 section incorporates the use of a downward protruding foot 6 located at each of the three points of a triangle. The furthest downward projection of the foot 6 is narrowed into a prong 7 that will either rest on the grassy surface of the golf course or with downward pressure applied to the foot 6 the prong 7 will penetrate the ground 5.

The feet 6 of the bottom 4 section of the golf bag are positioned at the outermost point of the triangle thereby giving support to and bearing the entire weight of the golf bag 1 and contents above. The feet 6 triangularly arranged are outside the circumference of the golf club container 2 above.

The bottom 4 section of the first embodiment of this invention is comprised of two parts. The first part is a faring 8 made of lightweight plastic and the second part is a foot plate 9 made of a hard plastic material. These two parts are fastened together in any manner, usually by screws or rivets. The first embodiment bottom 4 section is shown in a triangular shape but may be round or a variation of these shapes.

The bottom section of the second embodiment 10 is comprised of three parts. The first part is a faring 8 identical to the faring 8 used in the bottom section 4 of the first embodiment. The second part is a leg plate 11 made of a hard plastic material with channel sockets 12 running from the tip of each point of the triangle to the center of the leg plate 11.

The third part of the second embodiment is the leg-foot 13 that slides into each of the three channel sockets 12.

The channel socket 12 has an eight sided opening 14*a, b, c, d, e, f, g, h* that corresponds to an eight sided flange 15*a, b, c, d, e, f, g, h* of the leg-foot 13, which enable the leg-foot 13 to slide in and out of the channel socket 12.

When the leg-foot 13 is in its fully retracted position 16 in the channel socket 12 or when in the leg-foot 13 is in its extended position 17 the leg-foot 13 is held in position by a tab 18 located on the underside of the leg-foot 13.

The channel socket 12 has a retracted position hole 19 and an extended position hole 20 formed to receive the leg-foot tab 18 and to hold the leg-foot 13 in the desired position.

The third embodiment bottom section 21 is a single molded part shown here in a round shape, but may be triangular or a variation of these shapes, with the third embodiment feet 22 positioned in a tripod design and integrated with the bottom section 21.

The fourth embodiment consists of three separate parts, namely, a fourth embodiment leg plate 23, a fourth embodiment leg-foot 24, and a fourth embodiment bottom section 25, shown here in a round shape, but may be triangular or any similar shape.

The fourth embodiment leg plate 23 and the fourth embodiment leg foot operate together in the same manner as the second embodiment leg plate 11 and leg foot 13 described above.

In the fourth embodiment the leg plate 23 has a channel socket 26 for each leg foot 24. Each channel socket incorporates a retracted position hole 27 and an extended position hole 28. These positioning holes receive the fourth embodiment leg-foot tab 29 located at the end of the leg-foot 24.

The leg-foot 24 is fixed in the retracted position 30 when the leg-foot 24 is slid into the channel socket 26 and the leg-foot tab 29 is received by the retracted position hole 27.

The leg-foot 24 is fixed in the extended position 31 when the leg-foot 24 is slid into the channel socket 26 and the leg-foot tab 29 is received by the extended position hole 28.

Figure 6:
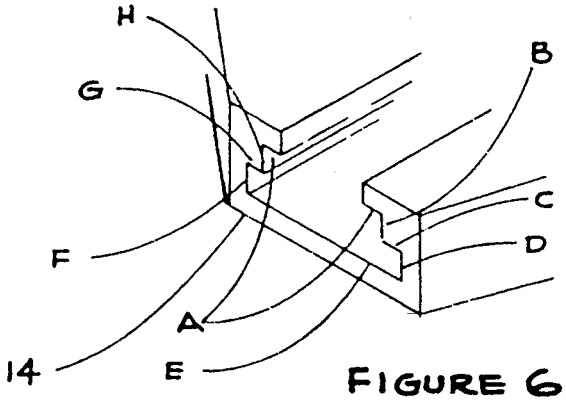
FIG. 6 shows an enlargement of the channel socket opening.
Figure 7:
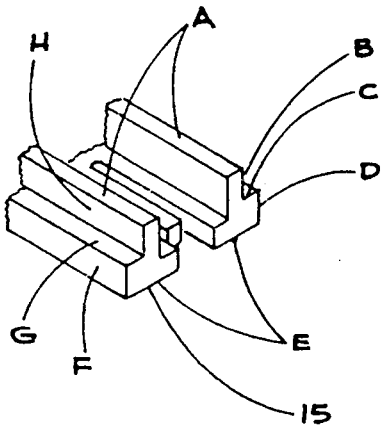
FIG. 7 shows an enlargement of the leg-foot flange.
Figure 8:
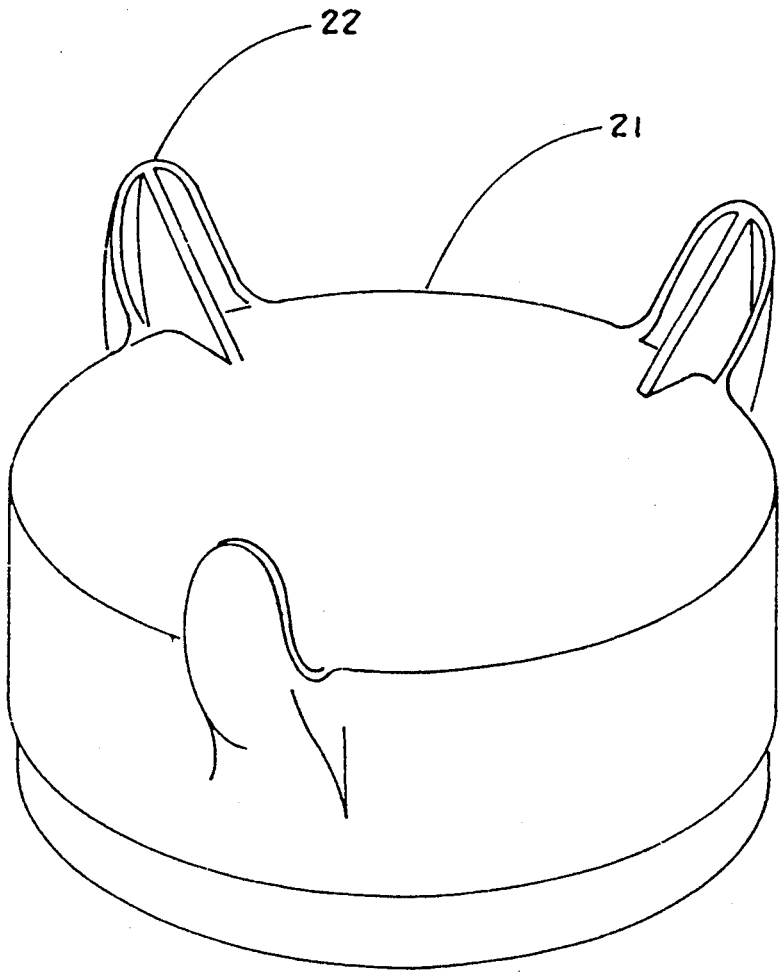
FIG. 8 shows the third embodiment of the closed bottom section of the golf bag turned upside down.
Figure 9:
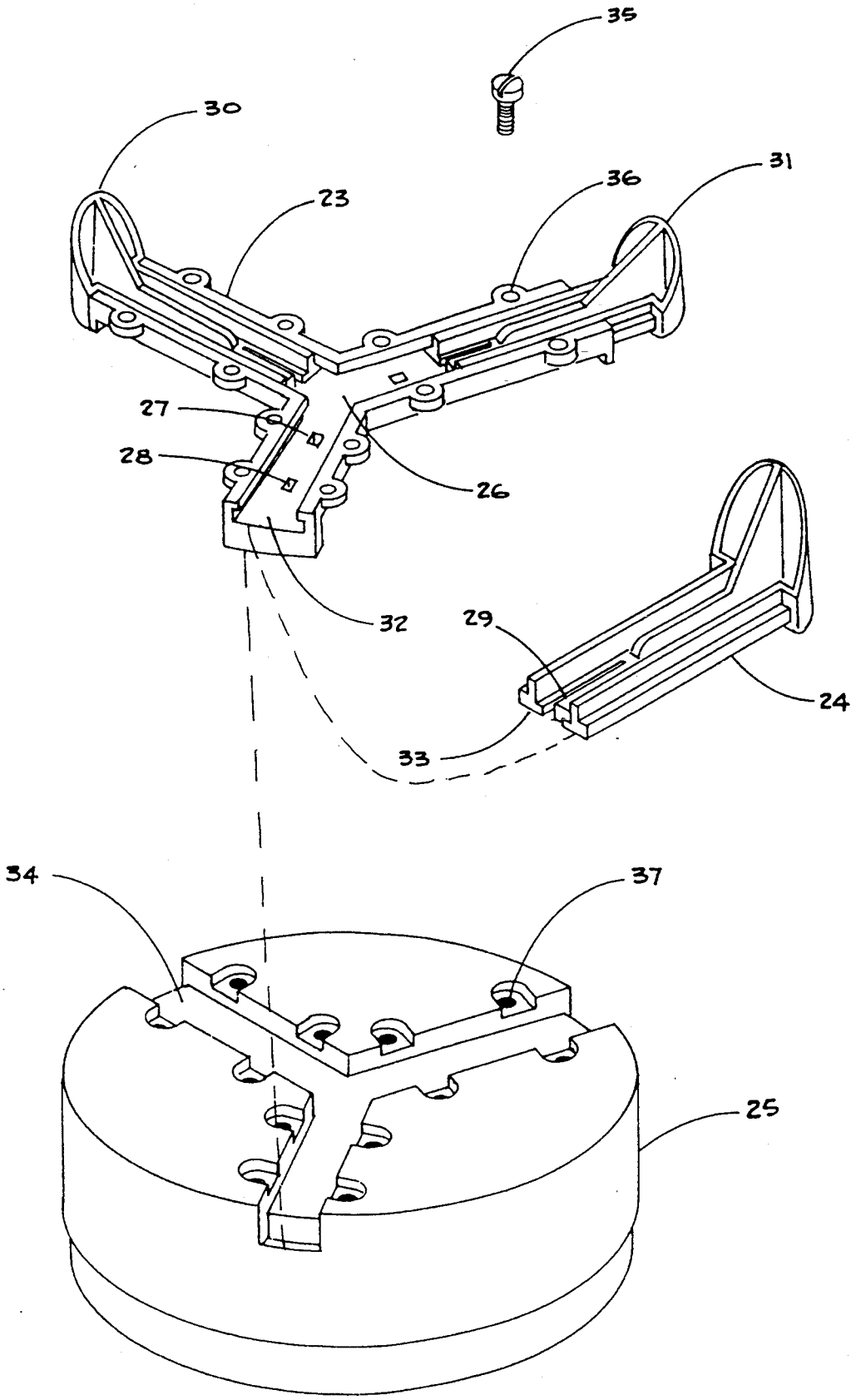
FIG. 9 shows the fourth embodiment of the invention. The fourth embodiment leg plate is turned upside down and shows a fourth embodiment leg-foot in a retracted position, an extended position, and a removed position. Also the fourth embodiment bottom section is turned upside down showing the fourth embodiment bottom section channel for receiving the fourth embodiment leg plate.
Figure 10:
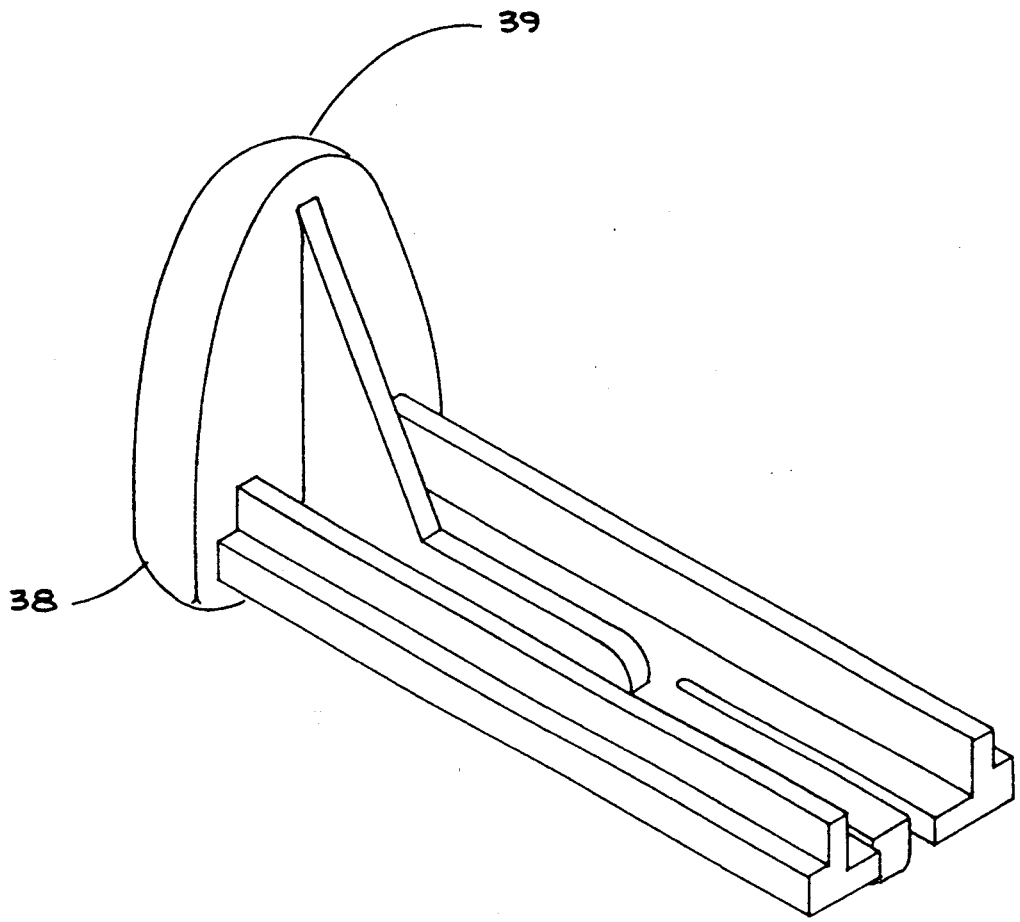
FIG. 10 shows an alternate leg-foot design.

The fourth embodiment channel socket 26 has an eight sided channel socket opening 32 that corresponds to an eight sided leg-foot flange 33 of the leg foot 24 identical to the second embodiment channel socket opening 14 and flange 15 described in FIGS. 6 and 7.

The fourth embodiment bottom section 25 incorporates a leg plate receiving, channel 34 that receives the leg plate 23. The two pieces are fastened together by twelve screws 35 attached through a leg plate screw hole 36 and received by a screw thread insert 37 moulded into the fourth embodiment bottom section 25.

In the second and fourth embodiments, the leg foot 13, 24 as described above may be exchanged for the first alternate leg foot 38 design. The first alternate leg foot 38 has a blunt prong 39 and therefore will rest more easily on the surface of a wet golf course than the previously described leg-foot 13, 24.

The four embodiments of this invention enables the golfer to move the golf bag 1 from his shoulder or hand and stabilize the golf bag 1 vertically by positioning the feet 6, 13, 22, 24 of the bottom section 4, 10, 21, 25 of the golf bag 1 on the ground 5. If the ground 5 is level no further adjustment is necessary. If the ground 5 is sloped the golfer may apply pressure to the top of the uphill foot 6, 13, 22, 24 thereby penetrating the grassy surface of the golf course to the degree necessary to align the golf bag 1 vertically. With hands free the golfer may then survey the next shot, obtain yardage and then select a club from the bag 1 without bending over. After the shot is completed the club is returned to the upright golf bag 1 and hoisted onto the golfer's shoulder again without bending over.

When the golfer is using the second and fourth embodiments of the invention the leg-foot 13, 24 may be moved to the extended position 17, 31 at any time to increase stability. The leg-foot 13, 24 is moved to the extended position 17, 31 by the golfer holding the end of the leg-foot 13, 24 and pulling the leg-foot 13, 24 outward from the leg plate 11, 23. With this force applied the leg-foot tab 18, 29 will release from the retracted position hole 19, 30 and slide into the extended position hole 20, 31. At the completion of play the leg-foot 13, 24 may be retracted or removed for space saving and storage purposes.

Figure 11:
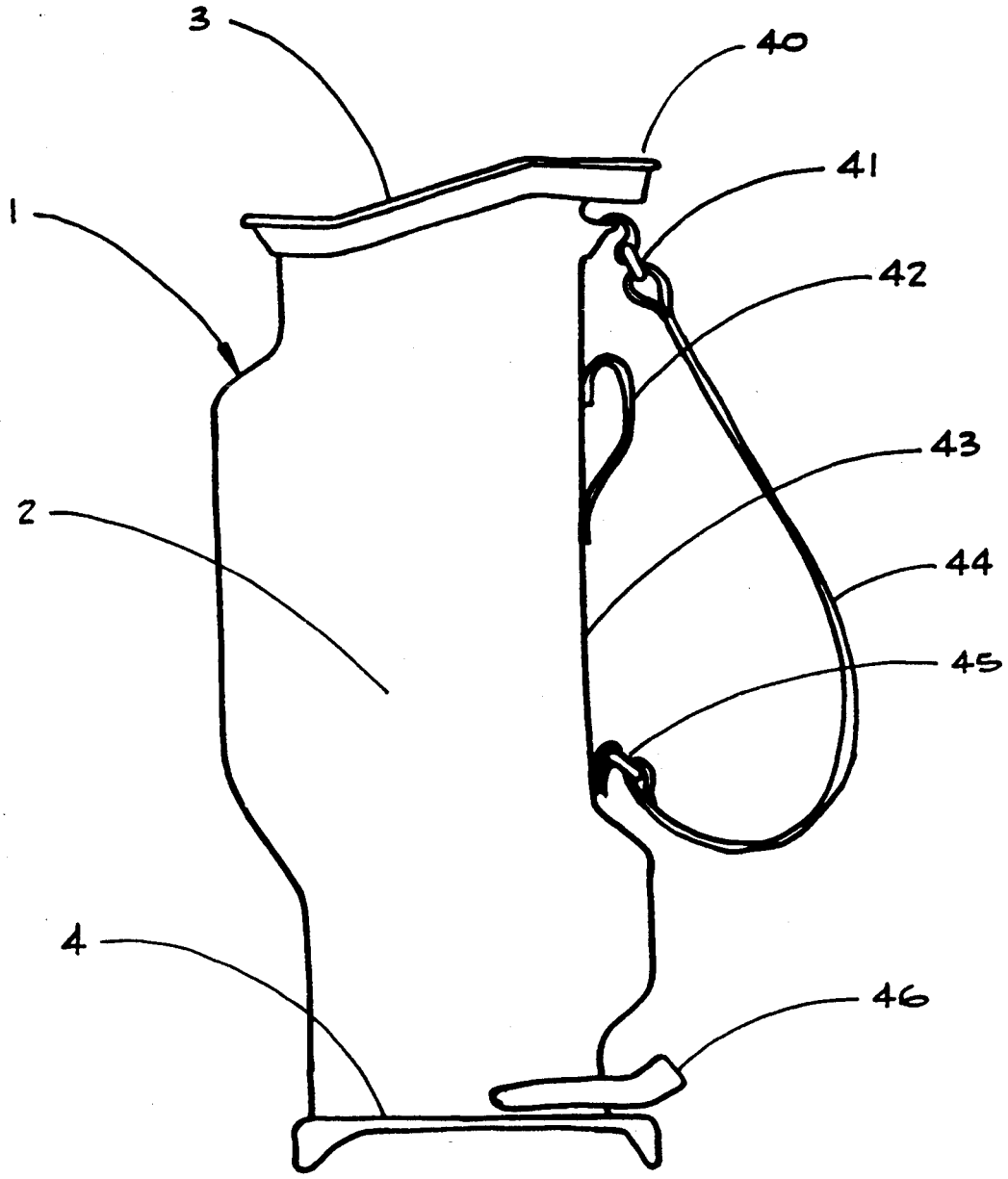
FIG. 11 shows a profile view of a common golf bag with the invention.

The side profile of a conventional golf bag 1 shown in FIG. 11 is illustrated with the throat hand grasp 40 of the present invention attached as an integral part of the throat structure 3. Immediately below and attached to the throat structure 3 is the golf club container 43 which in turn is attached to the closed bottom section 4. A fabric shirt 2 surrounds the golf club container 43 and overlaps at the top of the throat structure 3 and at the opposite end of the closed bottom section 4.

Also shown in FIG. 11 are three conventional handling devices, namely, a shoulder sling 44, a middle hand grasp 42 located between the top shoulder sling fastener 41 and the bottom shoulder sling fastener 45, and a bottom hand grasp 46.

Figure 12:
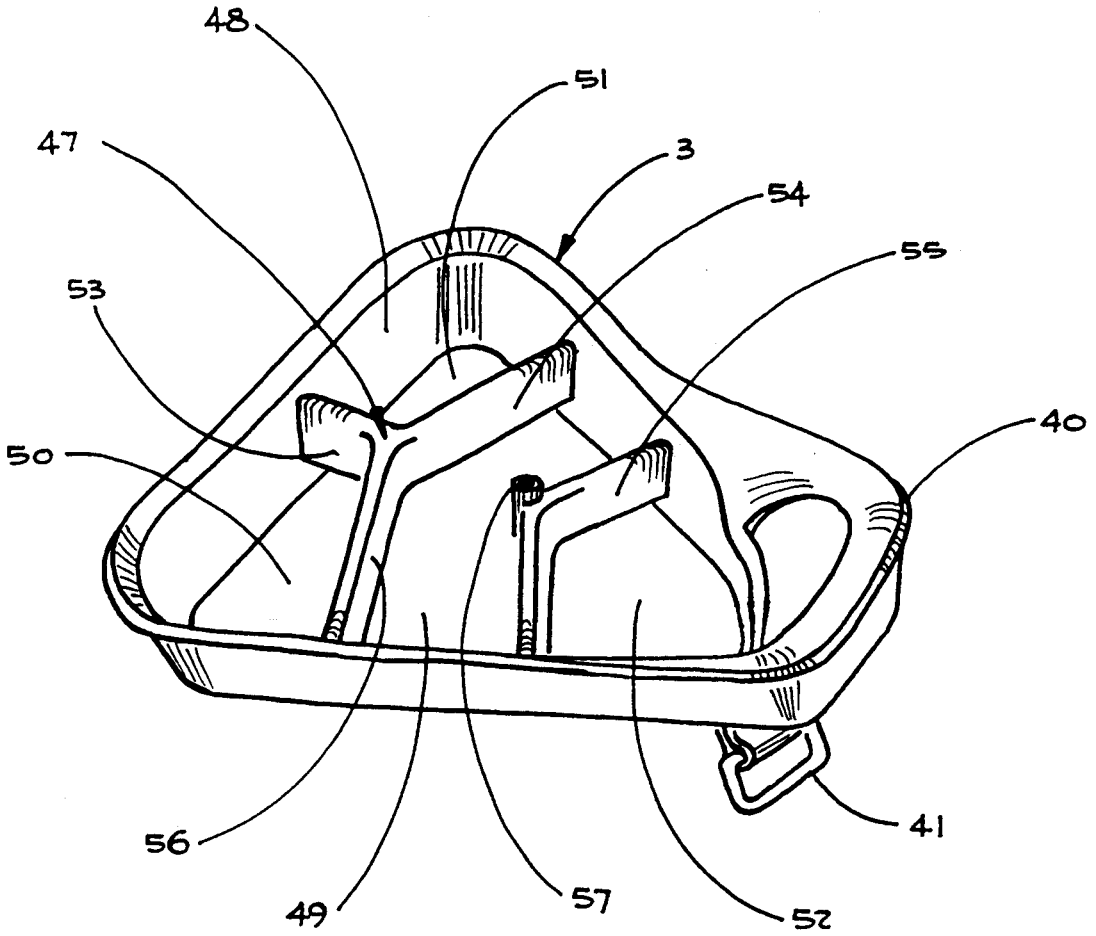
FIG. 12 shows a perspective top view of the throat structure with the invention.

Referring to FIG. 12 and throat structure 3 apart from the golf bag 1 is shown by perspective top view. The location of the top shoulder sling fastener 41 is shown along with the throat hand grasp 40 located immediately above.

FIG. 12 also illustrates the throat structure 3 with the lower throat club divider 47 and the upper throat club divider 55 shown within. Also viewed in this figure is the throat hand grasp 40 located beyond the circumference of the throat structure 3 and the position for the top shoulder sling fastener 41 shown affixed to the throat structure 3.

From these drawings it is clear that the throat hand grasp 40 provides a handling device not previously found on golf bags. This invention will be particularly useful to the golfer or his caddie when moving the golf bag 1 from a shoulder carrying position to rest the golf bag 1 on the ground in a vertical position. With that maneuver the person carrying the golf bag 1 will grasp the throat hand grasp 40 with the hand opposite the shoulder which is carrying the golf bag 1 as the golf bag 1 is being,removed from the shoulder, and rested vertically on the ground.

The invention will also be useful when the golfer or his caddie moves the golf bag 1 to or from a location that may be awkward such as the trunk of an automobile. In such cases one hand will grasp the throat hand grab 40 and the other hand will grasp the bottom hand grasp 46 which grasps will then bear the entire weight of the golf bag 1 as it is moved from one location to another.

The invention illustrated in FIG. 12 shows the triangular golf bag throat structure 3 separated from the remainder of the golf bag and also depicts the lower throat club divider 47 and upper throat club divider 55 design.

This lower throat club divider 47 provides and open area in two corners of the triangular shaped throat structure 3. The left open area 51 is defined by a short divider 53 and portion 54 and right open area 50 is defined by short divider 53 and portion 56. A top open area 52 is defined by upper throat club divider 55. The fourth open area in FIG. 12 is identified as center opened area 49 defined by portions 54 and 56 and upper throat club divider 55.

Under the Rules of Golf the player is permitted use of fourteen golf clubs during the game. The lower throat club divider 47 and upper throat divider 55 permits the golfer to organize these golf clubs in four groups. As this is done the golfer will find that his golf bag is more stable with the use of this invention both when carried in a horizontal position or rested in a vertical position. Stability is achieved by the use of club divider 47 and 55 which confines a group of golf clubs to the top open area 52, the left open area 51 and the right open area 50. Confining groups of golf clubs to the three vertices of the triangular shape of the club divider 47 and 55 prevents excessive sliding of golf clubs from side to side promotes stability of the golf bag as it is moved from one place to another around the golf course.

In addition, The golfer or his caddie will find that as the golf bag is carried horizontally the golf clubs in the top open area 52 and the center open area 49 will gather in the center of the golf bag throat structure 3 as a result of the chevron shaped upper throat club divider 55 and lower throat club divider 47. This design also promotes stability of the golf bag when moved from a carried horizontal position to a resting vertical position.

Finally, hole 57 in upper throat club divider 55 allows a cover (not shown) to be fixed over the clubs.

I claim:

1. A throat structure for the top end of a golf bag comprising:

a triangular ring-shaped member internally joined together by means of a lower throat club divider, a short divider extending between said lower throat club divider and said ring-shaped member and an upper throat club divider such that a top open area, a left open area and a right open area are formed at the vertices of said triangular ring-shaped member.

2. The throat structure of claim 1 where said lower throat club divider is Y-shaped and forms the base of a center open area.

3. The throat structure of claim 1 additionally comprising a hole in said upper throat club divider.

* * * * *